United States Patent [19]

Yang et al.

[11] Patent Number: 4,602,357

[45] Date of Patent: Jul. 22, 1986

[54] CODED ACOUSTIC ALARM TRANSMITTER/RECEIVER SYSTEM

[75] Inventors: Ta-Lun Yang, Rockville, Md.; Paul Broome, Luray, Va.

[73] Assignee: Ensco Inc., Springfield, Va.

[21] Appl. No.: 483,907

[22] Filed: Apr. 11, 1983

Related U.S. Application Data

[63] Continuation-in-part of Ser. No. 348,245, Jul. 15, 1985, Pat. No. 4,473,821.

[51] Int. Cl.[4] ..... G08B 19/00; G08B 13/08; G08B 13/14; G08B 17/06

[52] U.S. Cl. ..... 367/93; 340/521; 340/531; 340/574; 340/825.74

[58] Field of Search ..... 367/93; 340/531, 825.74, 340/825.72, 696, 521, 574, 571, 539

[56] References Cited

U.S. PATENT DOCUMENTS

| | | | |
|---|---|---|---|
| 2,905,762 | 9/1959 | Rettie et al. | 340/521 |
| 3,040,298 | 6/1962 | Thomas, Jr. et al. | 340/825.74 |
| 3,696,384 | 10/1972 | Lester | 340/312 |
| 3,798,600 | 3/1974 | Saikaishi et al. | 367/199 |
| 3,805,265 | 4/1974 | Lester | 343/6.5 R |
| 3,836,901 | 9/1974 | Matto et al. | 340/571 |
| 4,063,410 | 12/1977 | Welling | 367/117 |
| 4,088,995 | 5/1978 | Paladino | 340/384 E |
| 4,157,540 | 6/1979 | Oros | 340/574 |
| 4,189,720 | 2/1980 | Lott | 340/539 |
| 4,189,721 | 2/1980 | Doell | 340/574 |
| 4,207,559 | 6/1980 | Meyer | 340/531 |
| 4,284,983 | 8/1981 | Lent | 340/571 |
| 4,367,458 | 1/1983 | Hackett . | |
| 4,446,454 | 5/1984 | Pyle | 340/521 |
| 4,450,436 | 5/1984 | Massa | 340/531 |
| 4,473,821 | 9/1984 | Yang et al. | 340/825.74 |

*Primary Examiner*—Glen R. Swann, III

*Attorney, Agent, or Firm*—Sixbey, Friedman & Leedom

[57] ABSTRACT

The coded acoustic alarm transmitter/receiver system includes a transmitter for selectively providing both an audible alarm in the audio frequency range and a silent alarm in the ultrasonic frequency range. These alarm signals may be provided by a plurality of signals of different frequencies transmitted simultaneously in either the audio or ultrasonic frequency ranges. Receiver units are tuned to receive specific frequencies from a specific transmitter or group of transmitters.

11 Claims, 3 Drawing Figures

CODED ACOUSTIC ALARM TRANSMITTER/RECEIVER SYSTEM

This application is a continuation-in-part of the copending U.S. application Ser. No. 348,245, filed July 15, 1985, now U.S. Pat. No. 4,473,821.

TECHNICAL FIELD

The present invention relates to alarm systems generally, and more particularly to an alarm system in which a transmitter is adapted to provide an alarm signal which is unique to a specific transmitter.

BACKGROUND ART

Traditional security systems are generally designed for a specific use, and consequently are not adapted to perform a multiplicity of functions. For example, security systems have been used as intrusion sensing units to secure a building or other enclosure by locating intrusion sensors at doors, windows, and other secured openings. These intrusion sensors may employ infared, microwave, and ultrasonic motion detectors, or photoelectric beams which are broken when an intrusion occurs. Such systems are generally static systems which are wired to a building power supply, and consequently these systems are not adaptable to other uses.

Known security systems also include alarm systems which are specifically designed to protect personal property which may be easily moved and concealed. These systems, which are widely used in department stores and similar merchandising institutions, generally employ fixed receiver units located at specific points in the store. These receiver units are responsive to special tags or other removable transmitting devices which may attached to the personal property. If these transponders are not removed from the property, an alarm will be triggered as the property is moved past a gate equipped with a sensing receiver unit.

Finally, traditional security systems include a number of personal alarm systems which generally include at least a portable transmitter. One category of personal alarm system is designed to operate in the audio range and provide a loud noise to attract the attention of people in the vicinity who might provide aid to the party triggering the alarm. Another type of personal alarm system is the silent alarm which provides no audible signal in the vicinity of the alarm transmitter. Systems of this type generally employ radio signals which are picked up by receivers installed in a protected area, and these systems transmit some type of identification code unique to the transmitter.

In an attempt to provide a security system which is more versatile than the traditional security systems, a multi-function security system has recently been devised which is based upon ultrasonic energy transmission. The major units of this system are primarily interconnected by ultrasonic sound waves and thus require no installation wire. Such a system, as disclosed in U.S. Pat. No. 4,367,458 to Kenneth R. Hackett, utilizes a plurality of transponders which can be interrogated from a central data unit for reporting back operative or inoperative condition alarm situations in the vicinity of local transponders. Although multiple functions may be provided by the system by initial programming and by key control operation of the system once it is installed, this ultrasonic system is still primarily a static system which cannot be adapted for a plurality of different uses. Additionally, although this known prior art system employs transponders capable of transmission and reception of a plurality of different ultrasonic frequencies, the frequencies are transmitted sequentially and not simultaneously, and all of the transmitted frequencies are in the non-audible range. Thus, the system is not adapted to provide an audible signal.

DISCLOSURE OF THE INVENTION

It is a primary object of the present invention to provide a novel and improved coded acoustic alarm transmitter/receiver system which is adapted for universal use as an intrusion alarm system, a personal property protection alarm system, or a personal alarm system without requiring system component alteration. In fact, a single coded acoustic alarm transmitter/receiver system of the present invention may be simultaneously employed to protect personnel and personal property as well as to indicate intrusion into a supervised area.

Another object of the present invention is to provide a novel and improved coded acoustic alarm transmitter/receiver system wherein each alarm transmitter provides a coded output signal which is unique to both the transmitter and to a specific central receiver system. This signal will not be operable with other receiver systems tuned to other alarm transmitters of a similar type.

A further object of the present invention is to provide a novel and improved coded acoustic alarm transmitter/receiver system which includes transmitter units adapted to provide both audible coded alarm signals in the audio range as well as inaudible ultrasonic coded signals. Thus, the transmitter units for the system are adapted to provide both audible and silent alarms.

Yet another object of the present invention is to provide a novel and improved coded acoustic alarm transmitter/receiver system which includes a miniature portable transmitter capable of producing both an audible alarm in the audio frequency range and a silent alarm in the ultrasonic frequency range. Both alarms include a time pulse code pattern or other code to identify the specific transmitter, and the code pattern may be repeated a number of times to increase the likelihood of detection. Each individual transmitter may be provided with a condition sensing unit which will selectively cause the transmitter to provide, in a predetermined sequence, the audible and silent alarms depending upon a sensed condition.

A further object of the present invention is to provide a novel and improved coded acoustic alarm transmitter/receiver system which consists of a plurality of receivers installed in areas requiring protection, combined with a plurality of portable transmitters capable of sending out a coded signal upon activation of a transmitter. The coded signal can be in the acoustic range, or in the ultrasonic range, depending upon whether audible or silent alarms are desired. The alarm signal is received and decoded by a receiver in the area of the transmitter which can perform subsequent alarm reporting functions. The receiver operates to identify the transmitter unit reporting the alarm, the nature of the alarm, and the location of the alarm.

Another object of the present invention is to provide a novel and improved coded acoustic alarm transmitter/receiver system having a transmitter adapted to provide a coded signal to a receiver within range of the transmitter. The coded signal transmitted by the transmitter is formed by a plurality of different sonic frequencies which are simultaneously transmitted in either the audio or the ultrasonic frequency range. One or more of these frequencies includes a time pulse code pattern or other code to identify the specific transmitter. One unique code pattern may be transmitted in the audio range while a second unique code pattern may be transmitted in the ultrasonic frequency range to indicate different alarm conditions sensed by the same transmitter.

A still further object of the present invention is to provide a novel and improved coded acoustic alarm transmitter/receiver system which facilitates the tracking of both portable property objects and personnel in an area protected by the system.

Other objects and advantages of this invention will become apparent to those skilled in the art from a consideration of the following specification and claims taken in conjunction with the accompanying drawings.

More specifically, in accordance with the aforesaid objects, the present invention provides a coded acoustic alarm transmitter/receiver system having a miniature portable transmitter containing its own power source. For any specific system, a plurality of miniature transmitters may be employed, and preferably each transmitter emits coded signals which may be received only by receivers in the specific system which incorporates the transmitter. The transmitters in any one system may be used for a multiplicity of different alarm conditions including intrusion detection, personnel alarm use, and personal property security. Intrusion alarm transmitters and personal property security transmitters include condition sensing units which operate in response to a physical condition to activate the transmitter. Transmitters in the system employed for a personnel alarm function are manually triggered by a person using the transmitter. However, all transmitters provide a specific code associated with the transmitter which is received by a receiver within range of the transmitter. The transmitter code is modulated upon an acoustic signal which might constitute either an audible signal, an ultrasonic silent signal, or both. The transmitters are adapted to provide either an audible or a silent signal in response to a predetermined physical condition, in response to the elapse of a predetermined time period, or in response to a manual control switch on the transmitter. Both the silent and the audible signals may be composed of a group of different unique frequencies which are transmitted simultaneously by a transmitter and which may be received only by receivers in an alarm system associated with the transmitter.

BEST MODE FOR CARRYING OUT THE INVENTION

Figure 1:
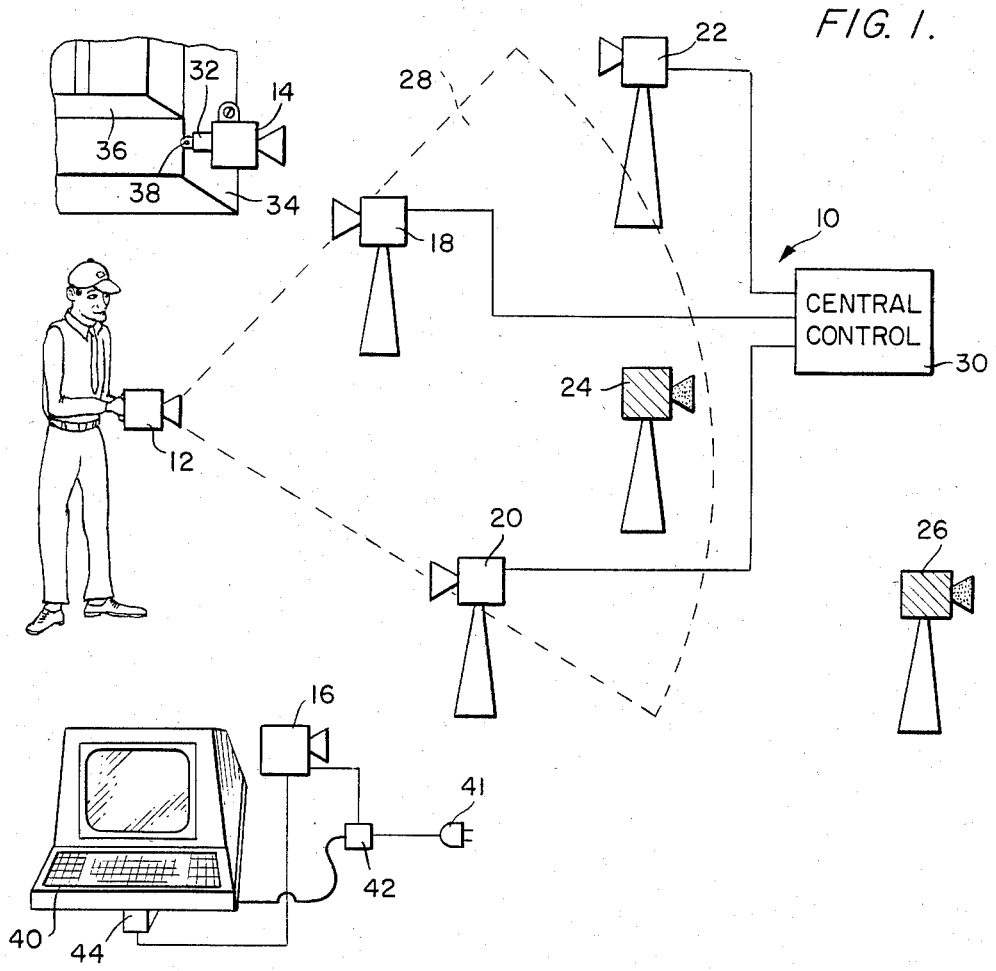
FIG. 1 is a diagrammatic view showing the arrangement of the coded acoustic alarm transmitter/receiver system of the present invention.

Referring now to FIG. 1, the coded acoustic alarm transmitter/receiver system of the present invention indicated generally at 10 consists of transmitters 12, 14, and 16 which may be triggered to produce an acoustic signal. As will be hereinafter explained in greater detail, this signal may be in the audio range of frequencies, the ultrasonic range or frequencies, or both. Signals from the transmitters 12, 14 and 16 may be received by receivers 18, 20, and 22 which are in the coded acoustic alarm transmitter/receiver system 10 with these transmitters, but similar receivers 24 and 26, which are associated with some other coded acoustic alarm transmitter/receiver system, are not tuned to receive signals from the transmitters 12, 14 and 16. These receivers are tuned to different transmitter frequencies, and this frequency differential can prove extremely important in instances where two coded acoustic alarm transmitter/-receiver systems are employed in adjacent areas. When such systems are closely adjacent, a signal from one transmitter, such as the transmitter 12, may be received in an area 28 which includes a receiver 24 from another system. It is imperative that transmitters from one system be precluded from interferring with the receivers of another system.

FIG. 1 illustrates the manner in which the coded acoustic alarm transmitter/receiver system 10 of the present invention operates effectively to provide security against both intrusion and personal property theft as well as personnel security. Additionally, the system can also provide a means for tracking an intruder and for tracking personal property being moved by an intruder, as well as for guiding security personnel to the location of personal property carried by the intruder. The receivers 18, 20 and 22 of FIG. 1 are all connected to the central control unit 30. The connections between the receivers 18, 20 and 22 and the central control unit 30 may take the form of any conventional communication link, including dedicated wires, carriers transmitted over existing wires such as power or telephone lines and wireless radio wave links. In actuality, the coded acoustic alarm transducer/receiver system 10 would normally include a large number of receivers and a large number of transmitters, although only three receivers and three transmitters are shown for purposes of illustration of FIG. 1. The receivers of the systems would be spaced throughout premises to be protected, and may also be spaced in outside areas surrounding the premises such as parking lots, entrance areas, etc.

For intrusion protection, transmitters such as the transmitter 14 are positioned adjacent doors and windows to be protected. Each of these intrusion detection transmitters is activated by a condition responsive transducer 32 which, for example, senses when a door or window is open. The transmitter 14 is illustrated as being mounted upon a window frame 34 and, in this case, the condition responsive transducer 32 constitutes a microswitch which senses when a window 36 is raised. This microswitch could be of a known, normally closed type which is open when a switch button 38 is in the depressed condition. The switch button is positioned to be depressed by the window 36 when the window is in the closed position, but when the window is opened, the switch button 38 is extended thereby closing the microswitch circuit. This closure of the microswitch connects the transmitter 14 to an internal battery power supply which activates the transmitter.

A receiver, such as the receiver 18, is positioned within the range of each intrusion detection transmitter 14, and receipt by the receiver 18 of a coded signal transmitted by the transmitter 14 would then provide an indication to a central control unit 30 of intrusion at the window protected by the transmitter 14. The transmitter 14 might transmit only in the ultrasonic frequency range, thereby providing only a silent alarm, or the transmitter might transmit in the audio range to direct an alarm signal to receiver 18 while simultaneously providing an audible alarm which will startle an intruder and guide security personnel to the location where an intrusion has been made.

The physical condition responsive transducer 32 need not always be a microswitch, but may constitute a photoelectric beam system, or any other condition responsive transducer of conventional type which will sense an intrusion condition and activate the transmitter 14.

The transmitter 16 is employed as a protection device for a piece of electronic equipment, such as a computer 40. This transmitter is activated by various condition sensing transducers 42 and 44 which can cause the transmitter to provide a coded alarm signal to any receiver in the system 10, such as the receiver 20 which is within the range of the transmitter. The condition sensing transducers 42 and 44 may take numerous forms, so that an alarm indication may be provided in response to any predetermined condition of the computer 40. For example, the transducer 42 might be designed to activate the transmitter 16 when the power plug 46 for the computer is unplugged from a wall socket power supply. In its simplest form, the transducer 42 might consist of a microswitch similar to the microswitch 32 which is mounted on the plug 46 so that the microswitch button will be extended to close a power circuit to the transmitter 16 when the plug is unplugged. In a more complex form, the transducer 42 might sense the cessation of current flow through the power cord extending between plug 41 and the computer 40 and thereby cause a solenoid to move from a retracted to an open position wherein a switch would close a power circuit to the transmitter 16.

The second condition responsive transducer 44 might be formed by a thermal responsive switch which would close and activate the transmitter 16 in case the computer 40 overheats or catches fire. Conversely, the condition responsive switch 44 might be of a type which would sense the movement of the computer 40 and activate the transmitter 16 in response to computer movement. For example, the transducer 44 might consist of an accelerometer type movement sensing switch or of a microswitch having a switch button which would be extended when the computer is lifted off a support surface.

In instances where the transmitter 16 is designed to selectively transmit an audible alarm signal as well as a silent alarm signal, such signal transmission may be selectively controlled by separate condition responsive transducers. For example, if the condition responsive transducer 44 is a temperature responsive transducer, it may be desirable to have this unit activate an audible transmission from the transmitter 16 so that personnel in the vicinity of the computer 40 are audibly notified that a dangerous temperature condition exists while, at the same time, the central control unit 30 is being notified of this condition. On the other hand, the condition responsive transducer 42 might be selectively connected to activate only a silent alarm transmission from the transmitter 16 when the plug 46 is removed.

The final transmitter 12 in the coded acoustic alarm transmitter/receiver system 10 is a personal alarm transmitter which is manually activated by a person carrying the transmitter. In a danger condition where the person bearing the transmitter is under attack or in eminent danger, the transmitter 12 may be activated in the audible mode to both notify the central control unit 30 while providing an audible call for help to persons within the audio range of the transmitter. In other instances, it may be desirable to have the transmitter 12 provide a silent alarm signal which is monitored only by the central control unit 30.

Transmitters intended for portable use, such as personnel protection transmitter 12 and equipment protection transmitter 16, will contain their own battery-type power source. The central control station 30, the receivers 18, 20 and 22, and the stationary transmitters such as the intrusion detection transmitter 14 may use external power sources although battery backup would be desirable to protect against power failures.

Before turning to a more detailed analysis of the construction of the transmitters and receivers employed in the coded acoustic alarm transmitter/receiver system 10, it will be beneficial to first consider how the system operates to provide an intruder alarm and location capability. First in a large protected facility, the first indication of an intruder might be provided by the transmitter 14 at the intruder point of entry. The coded signal provided by the transmitter 14 to the receiver 18 would indicate to the central control unit 30 that an intrusion had taken place and would provide the location of the intrusion. At this point, security personnel having personal alarm transmitters 12 might be alerted and directed to the location of the transmitter 14. As these security personnel move toward the designated location, the personal alarm transmitter 12 of each could be activated to provide a uniquely coded silent alarm to system receivers within transmitter range. This would enable the central control unit 30 to track the location of each security transmitter without alerting the intruder. Meanwhile, should the intruder move from the point of entry to the location of the computer 40, unplug the computer, and attempt to remove the computer from the premises, the alarm 16 would be activated to thereby inform the central control 30 that an unauthorized movement of the computer had occurred. As the intruder moves through the protected premises, the transmitter 16 would sequentially provide a signal to receivers located within the range of the transmitter, thereby permitting the central control 30 to track the location of the computer and to redirect security personnel to intercept the intruder. It will be apparent that the unique code associated with each transmitter 12, 14 and 16 enables the central control unit to at all times track the location of both personal property and of security personnel. Thus, a very effective security system is provided.

Figure 2:
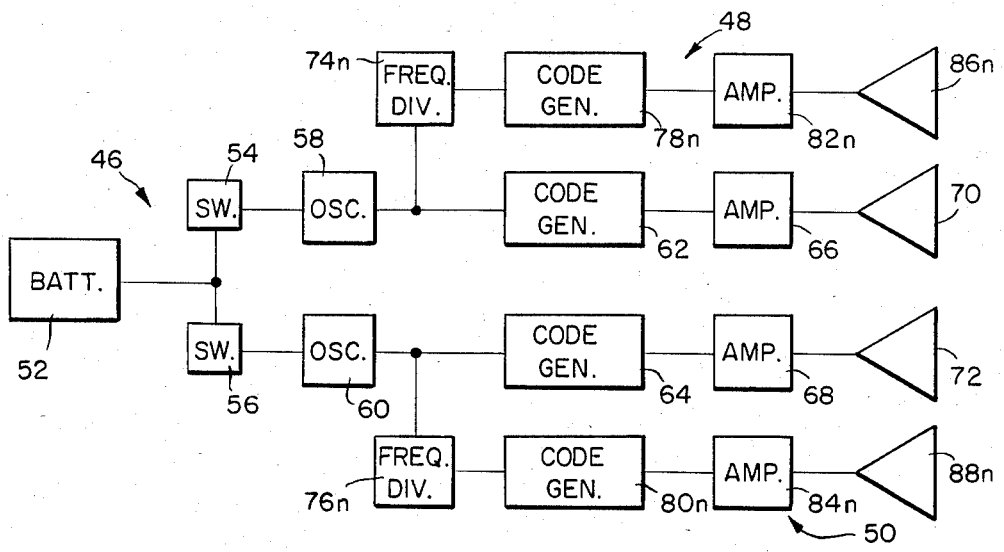
FIG. 2 is a block diagram of a transmitter circuit for the system of FIG. 1.

The transmitters 12, 14 and 16, may incorporate any one of a number of known acoustic transmitters adapted to transmit a sonic signal of a specified frequency. However, unlike a conventional single frequency sonic generator, the transmitter of the present invention includes a plurality of single frequency circuits which enable the transmitter to transmit both signals in the audio and ultrasonic frequency ranges. Additionally, it is preferable that the transmitter provide at least two different audio frequency signals and at least two ultrasonic frequency signals. Referring to FIG. 2, a transmitter indicated generally at 46, in its simplest form, includes an ultrasonic frequency silent signal generation section 48 and an audio frequency signal generation section 50. The transmitter is powered by a battery 52 which; upon selective operation of switches 54 and 56 will provide power to crystal controlled oscillators 58 and 60 respectively. The crystal controlled oscillator 58 regulates the frequency of the sound provided by the ultrasonic transmitting section 48 while the crystal controlled oscillator 60 regulates the frequency of the sound provided by the audio frequency section 50. In a personal alarm transmitter of the type shown at 12 in FIG. 1, the switches 54 and 56 may be manually actuated to selectively transmit either an audio or a silent alarm signal. Conversely, the switches 54 and 56 may constitute transducers of the type shown at 42 and 44 in FIG. 1 which connect a selected oscillator to the battery 52 in response to a sensed condition. Finally, if a combined audio and ultrasonic frequency transmitter is to be employed for the transmitter 14 of FIG. 1, one of the switches 54 or 56 would be provided by the microswitch 32. The remaining switch would be replaced by a timer which would initiate operation of the remaining transmitting circuit after the first transmitting circuit had been activated.

Code generators 62 and 64 operate to encode the output signals from the oscillators 58 and 60. These code generators may be of a number of known types, and may include programmable encode chips wherein appropriate cuts in the data lead inputs to the code generator are used to set the desired binary Manchester code which will be output to the unit. Such programmable coded encoders are manufactured by Supertex, Inc. of Sunnyvale, California under the designation ED-9 or ED-15. A number of other known code generators may be employed, such as the simple code generators used in sonic garage door operators.

Each code generator 62 and 64 may be preset to a specific single code to be maintained, or, in the alternative, the code generator may be of the type wherein a switch is employed to select one of a plurality of codes. For a plurality of codes, the code generator might constitute a logic waveform generator with the code being selectable for different settings in a code switch.

In the case of the personal alarm transmitter 12, the code generators 62 and 64 may be set to the same code, for in this case, the code merely indicates the identity of the transmitter providing the acoustic signals to the central control unit 30. Similarly, the code generators in the transmitter unit 14 may also be set to the same code. Conversely, however, the code generators 62 and 64 in the transmitter 16 may be set to different codes, both of which are unique to the transmitter and thereby identify the transmitter to the central control unit 30. However, the audio code generator 64 would be set to one code which not only identifies the transmitter but also indicates that an audio signal is being transmitted so that the central unit knows that a specific condition, such as an over temperature or fire condition exists at the computer 40. The code generator 62, which is the silent alarm code generator, would then be set for a second code so that the central control unit 30 knows that the computer 40 is being illegally transported from its normal location.

The encoded signals from the code generators 62 and 64 are amplified in amplifiers 66 and 68 which increase the power of the coded signals to provide driving signals for sound transducers 70 and 72. The sound transducers may constitute any known unit for transmitting sonic signals in the ultrasonic and audio range, but typically such transducers are formed by ceramic-metal resonant disc devices of the Murata Erie type, PKM 28-3A0. This transducer, and similar piezoelectric acoustic transducers used as a sound generator, employ a circular metallic disc with a thin layer of piezoelectric element bonded to it on one side. When the driving signal is applied to the piezoelectric element, the distortion of the element due to the magnetostrictive effect will cause the metal disc to oscillate as a diaphram. To maximize the acoustic energy output, the disc can be driven at its natural fundamental frequency, and a container can be constructed to provide a Helmholtz resonator tuned to the same frequency. This usual method of construction will result in discs of different sizes and containers of different shapes and sizes or different frequencies of interest.

To this point, a basic acoustic transmitter constructed in accordance with the present invention has been described in connection with FIG. 2 wherein a single frequency signal in the ultrasonic range may be transmitted to provide a silent alarm signal, while a single frequency signal in the acoustic frequency range may be transmitted to provide an audible alarm. Both of these coded signals will be picked up by a receiver within the range of the transmitter and transmitted to the central control unit 30 in FIG. 1. Ideally, however, the transmitter 46 will transmit a plurality of different frequency signals in the ultrasonic frequency range from the ultrasonic transmitting section 48 and will also transmit a plurality of signals of different frequencies in the audio frequency range from the audio transmitting section 50. This is required to prevent spurious sounds in the transmission area 28 of FIG. 1 from triggering false alarms in the receivers for the coded acoustic alarm transmitter receiver system 10. For example, a car horn might produce one of the audio frequencies transmitted from the audio transmission section 50, but it is unlikely that all of a plurality of preselected, different audio frequencies would occur simultaneously in the area 28 so as to trigger a false alarm. Consequently, each of the transmitting sections 48 and 50 is provided with any desired number of additional frequency transmitting units designated by the numeral n. to accomplish this, the signals from the oscillators 58 and 60 are provided to frequency divider sections **74*n* and 76*n* that produce output signals which differ in frequency from those provided by the oscillators 58 and 60, but which are still within the ultrasonic and audio ranges respectively. The units 74*n* and 76*n* need not necessarily constitute frequency dividers, but could consist of frequency multipliers, harmonic generators, or any similar known device for changing the frequency of the signals produced by the oscillators 58 and 60. The output signals from the frequency dividers 74*n* and 76*n* are then provided to code generators 78*n* and 80*n* respectively which encode the signals in the same manner as did the code generators 62 and 64. The code generator 78*n* provides the same code as does the code generator 62, while the code generator 80*n* provides the same code as did the code generator 64. The coded outputs from the code generators 78*n* and 80*n* are then provided to amplifiers 82*n* and 84*n* which amplify the driving signals to the sound transducers 86*n* and 88*n*. In some instances, it is possible to eliminate the frequency dividers 74*n* and 76*n* and the code generators 78*n* and 80*n* and to feed the outputs from the code generators 62 and 64 directly to the amplifiers 82*n* and 84*n*. This can be accomplished by employing sound transducers 86*n* and 88*n* which differ in resonant construction from the transducers 70 and 72** respectively, and thus provide a different output frequency for the same driving frequency.

Figure 3:
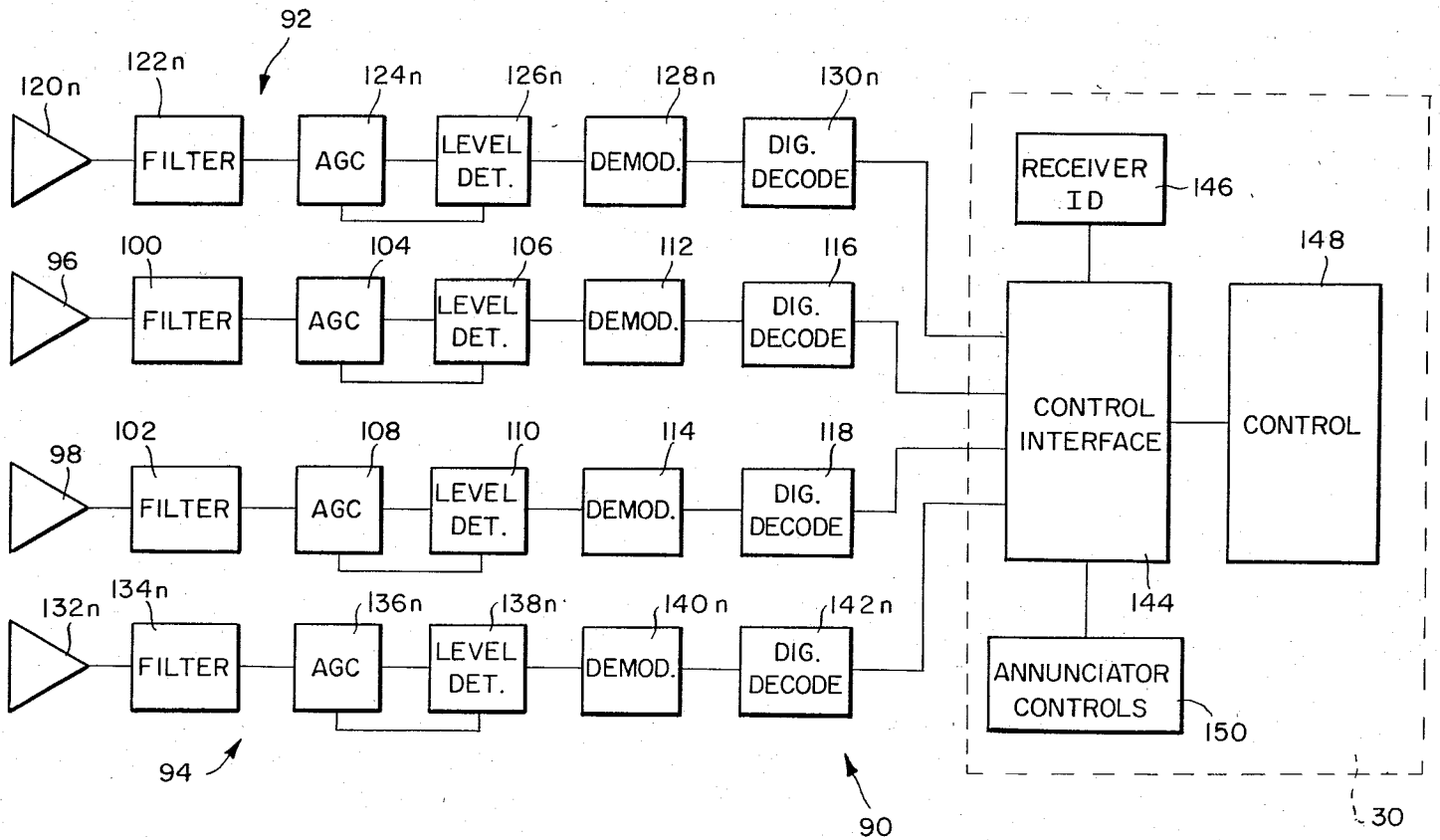
FIG. 3 is a block diagram of a receiver circuit for the system of FIG. 1.

A basic receiver of the type used for the receivers 18, 20, and 22 of FIG. 1 is illustrated at 90 in FIG. 3. The receiver 90 includes an ultrasonic frequency receiving section 92 and an audio frequency receiving section 94 to correspond to the ultrasonic and audio frequency transmitting sections of the transmitter 46. The basic receiver section for each ultrasonic frequency and audio frequency signal transmitted by the transmitter includes an ultrasonic signal receiver 96 and an audio frequency receiver 98. The receivers 96 and 98 may consist of microphones which monitor sounds present in the vicinity of the receiver 90. Each microphone may include a ceramic/metal disc mounted in a resonant acoustic chamber in a manner similar to the sound transducers 70, 72, 86*n* and 88*n* used in the transmitter, for such ceramic/metal discs provide a band pass filtering effect. The sound received in each sound receiver is converted to an electrical signal which is passed through a bandpass filter 100 and 102 to attenuate signals not at the frequency of interest. For example, the bandpass filter 100 is designed to pass the specific ultrasonic frequency band transmitted by the transmitting transducer 70, while the bandpass filter 102 is designed to pass the specific audio frequency band transmitted by the transmitting transducer 72. The frequency signal passed by the filter 100 then is directed to an automatic gain control circuit 104 and a level detector 106, while similarly, the signal passed by the band pass filter 102 is directed to an automatic gain control circuit 108 and a level detector 110. The level detectors 106 and 110 measure the signal energy level in the bandpass signal and regulate the automatic gain control circuits so that a desired constant signal level is maintained. Thus, the automatic gain control circuits are caused to adjust the signal in the frequency band to a fixed level of intensity to compensate for the fact that the transmitter may be different distances away from the receiver.

The signal output from the level detectors 106 and 110 then pass respectively to the demodulators 112 and 114 which extract the coded signal provided by the code generators 62, 64, 78*n* and 80*n* of the transmitter from the basic carrier frequency to provide binary time codes which can be interpreted by digital decoder. This demodulated signal is then furnished from the demodulators 112 and 114 to digital decoders 116 and 118 which include a storage section which stores the specific transmitter codes to be recognized. When the digital decoder sections confirm the receipt of an acceptable transmitter code, the transmitter code and a receiver identification code are provided to the central control unit 30. Additionally, simple alarms, such as a light annunicator, sirens, telephone dialers, etc. may be activated in response to a predetermined code.

If the transmitter 46 is designed to transmit a plurality of different frequencies both within the ultrasonic frequency range and the audio frequency range to the receiver 90, the receiver will contain a plurality of receiver channels which correspond to the number of transmitter channels. Each of these channels has components which correspohd to the basic components in the ultrasonic and audio receiver channels previously described. Thus, the additional ultrasonic receiver channels include receiver transducers 120*n* which feed signals through bandpass filters 122*n* to automatic gain control circuits 124*n* and level detectors 126*n*. The outputs from the level detectors 126*n* are demodulated in demodulators 128*n* and the demodulated signals are decoded in digital decoders 130*n* which output to the central control unit 30. Similarly, the audio frequency receiver channels include receiver transducers 132*n* which provide a signal through bandpass filters 134*n* and automatic gain control circuits 136*n* to level detectors 138*n*. The outputs from the level detectors are fed through demodulators 140*n* and digital decoders 142*n* which are connected to output to the central control unit 30. The central control unit 30 includes a control interface 144 which receives the outputs from the digital decoders and compares each with stored identification signals in a receiver identification section 146. The resultant information signals can be sent to a controller 148 for display and other purposes and in some instances to an annunicator control 150 which activates suitable alarms.

Industrial Applicability

The coded acoustic alarm transmitter/receiver system 10 of the present invention may be effectively employed for intrusion detection, personal property detection, personal safety, or a combination of these functions. The system may be employed effectively in protected areas to provide an intrusion alarm, and to subsequently provide an alarm if personal property is taken. The system also permits both security personnel and an intruder carrying personal property to be tracked during movement through protected permises. Additionally, the system provides the capability of sensing and providing an alarm condition for equipment overheating, fire, and other emergency conditions. Since the transmitters for the system are adapted to provide an audible and a silent alarm, the transmitters are well adapted to perform dual functions. Thus, an intrusion transmitter might be connected to a condition sensor so as to provide an audible alarm and transmission in response to fire, or some other emergency condition, while being connected to an intrusion sensor so as to provide a silent alarm when an intrusion is detected.

We claim:

1. A personal acoustic alarm unit having means for providing an audible alarm signal in the audio range comprising a first transmitter means including a first signal generating means for simultaneously generating a plurality of individual sonic signals in the audio frequency range, each such audio range sonic signal having an audio frequency which differs from that of the remaining audio range sonic signals, first code generator means connected to receive at least one of said individual audio range sonic signals and operating to apply a unique code thereto, and means for transmitting said audio range sonic signals simultaneously as an audible alarm signal; and means for providing a silent alarm signal outside of the audio range comprising a second transmitter means including a second signal generating means for simultaneously producing a plurality of individual sonic signals in the inaudible frequency range, each such inaudible range sonic signal having an audio frequency that differs from that of the remaining inaudible range sonic signals, second code generating means connected to receive at least one of said individual inaudible range sonic signals and operating to apply a unique code thereto, and second means for transmitting said inaudible range sonic signals simultaneously as a silent alarm signal; and actuating means for initiating operation of said first and second signal generating means.

2. A personal acoustic alarm unit as defined in claim 1, which includes first receiver means spaced from said first transmitter means for receiving said audible alarm signal, said first receiver means being tuned to receive said plurality of simultaneously transmitted audio range sonic signals and including decoder means to sense the unique code thereof; and second receiver means spaced from said second transmitter means for receiving said inaudible alarm signal, said second receiver means being tuned to receive said plurality of simultaneously transmitted inaudible range sonic signals and including decoder means to sense the unique code thereof.

3. A personal acoustic alarm unit as in claim 2, wherein said actuating means comprises manually actuatable means.

4. A personal acoustic alarm unit as in claim 1, wherein said actuating means comprises manually actuatable means.

5. An alarm system for protection of electronic equipment comprising a plurality of condition sensing transducer means each providing a respective signal in response to existence of a predetermined condition of the equipment, transmitter means operatively associated with the condition sensing transducer means, said transmitter means being activated by receipt of a condition responsive signal from any transducer means for transmitting an alarm signal, said transmitter means being provided with a first signal generating means for generating an acoustic signal in the audio frequency range and second signal generating means for generating an acoustic signal in the ultrasonic frequency range, at least one of said condition sensing transducer means being operable to activate the first signal generating means and at least one other of said sensing transducer means being operable to activate the second signal generating means.

6. An alarm system for protection of electronic equipment according to claim 5, wherein the condition sensing transducer means operable to activate the first signal generating means is responsive to existence of a dangerous condition and wherein the condition sensing transducer means operable to activate the second signal generating means is responsive to the occurrence of an unauthorized action.

7. An alarm system according to claim 6, wherein the condition sensing transducer means operable to activate the first signal generating means comprises a temperature responsive transducer.

8. An alarm system according to claim 7, wherein the condition sensing transducer means operable to activate the second signal generating means comprises a transducer that is responsive to disconnecting of the equipment from an electrical power source.

9. An alarm system according to claim 6, wherein the condition sensing transducer means operable to activate the second signal generating means comprises a transducer that is responsive to disconnecting of the equipment from an electrical power source.

10. An alarm system according to claim 6, wherein one of said condition sensing transducer means is responsive to movement of the equipment from an operational location.

11. An alarm system according to claim 6, wherein said electronic equipment is a computer.

* * * * *